United States Patent [19]

Simonelli

[11] Patent Number: 4,817,948

[45] Date of Patent: Apr. 4, 1989

[54] REDUCED-SCALE RACING SYSTEM

[76] Inventor: Louise Simonelli, 1560 E. 31st St., Brooklyn, N.Y. 11234

[21] Appl. No.: 529,724

[22] Filed: Sep. 6, 1983

[51] Int. Cl.[4] ..... A63H 30/04

[52] U.S. Cl. ..... 273/86 B; 434/63; 434/69; 434/71; 446/456; 244/190

[58] Field of Search ..... 273/86 R, 86 B; 434/62, 434/63, 66, 69, 71; 180/169; 358/108, 109, 210; 446/456; 244/190

[56] References Cited

U.S. PATENT DOCUMENTS

| | | | |
|---|---|---|---|
| 3,251,142 | 5/1966 | Jazbutis | 434/71 |
| 3,553,886 | 1/1971 | Hamilton | 446/456 |
| 3,564,134 | 2/1971 | Rue | 244/190 |
| 3,683,546 | 8/1972 | Congdon | 446/456 |
| 4,277,804 | 7/1981 | Robison | 358/108 |
| 4,386,914 | 6/1983 | Dustman | 244/190 |

*Primary Examiner*—Maryann Lastova
*Attorney, Agent, or Firm*—Herbert Dubno

[57] ABSTRACT

A reduced-scale racing apparatus having at least one self-powered, remotely controlled vehicle, and at least one operator's booth containing a control console for operating the vehicle, the vehicle having a wheeled body provided with a first control for controlling the vehicle, a forwardly trained video camera on the body, a rearwardly trained video camera on the body, a transmitter on the body for the wireless transmission of respective signals from the forwardly and rearwardly trained video cameras, and a receiver on the body responsive to wireless signals for operating the first control, while the operator's booth has a housing for containing a driver/operator and the control console, with a second control in the housing for generating wireless signals receivable by the receiver for operating the first control, the housing being further provided with a first video display screen responsive to the transmitted signals from the forwardly trained video camera for displaying the path in front of the vehicle, and a second video display screen in the housing responsive to the transmitted signals from the rearwardly trained video camera for displaying the path in back of the vehicle.

10 Claims, 4 Drawing Sheets

REDUCED-SCALE RACING SYSTEM

FIELD OF THE INVENTION

My present invention relates to a reduced-scale racing system which provides a more realistic sensation for the racer than hitherto existing racing systems utilizing remotely controlled vehicles. More particularly, the invention relates to a racing system in which the operator in all respects controls a remote vehicle by actions which would be necessary had the operator been in this vehicle.

BACKGROUND OF THE INVENTION

In spite of widespread appeal of participatory automobile and specialty vehicle races, the dangers to participant and the spectators has led to some concern over the years. However, efforts to substitute remotely controlled vehicles for the racer-driven cars, while also successful to a degree, are incapable of substituting for the participatory sport.

Miniature car-racing systems range from home assembled tracks with extremely small cars guided in slots of the track (slot car raceways) which are controlled by joysticks, dials or the like on a control box somewhat spaced from the track and generally connected thereto by wires. The cars are usually electrically powered and can be battery driven or driven by electric power picked up from the track.

Such systems have limited versatility and only very indirectly can represent actual track conditions or vehicle operations.

More realistic conditions are simulated at large slot car raceways in which electrically driven cars of larger scale, still a small fraction of the size of formula 1 or stock car racers, are controlled by an operator having an overview of the track and looking at his car from above.

In the largest of such earlier systems, even gasoline propelled vehicles may be remotely controlled as at still larger tracks, without the limitations of slot car racing, but also by an operator having an overview of the track and looking at his car and its relationship to the other vehicles on the track, and at the track itself, more as a spectator than as a participant.

The disadvantages of these systems have been recognized and many racing enthusiasts have viewed with limited favor various computer game-type simulations in which, under the control of a microprocessor or other preprogrammed unit, a track is displayed on a screen in a booth and the steering wheel and a brake control operated by the player can position the car along the track which rolls past the viewer.

While here the player does look upon the instantaneous circumstance from the vantage point of an operator, since no actual car or track is involved and the operator is simply handling an electronic instrument, much of the thrill, excitement and attraction of vehicle racing is lost.

OBJECTS OF THE INVENTION

It is the principal object of the present invention to provide a reduced scale racing system which obviates the aforedescribed disadvantages.

Another object of this invention is to provide a safe racing apparatus which, rather than simulating automobile racing, provides actual vehicle racing without danger to the participants or spectators and without the insulation of the participant from the actual track conditions which is inherent in either slot car racing or the more antiseptic use of electronic simulations.

It is also an object of this invention to provide a racing apparatus which will afford the participant of all the thrills and excitement of being in a racing vehicle during a race, but without any of the disadvantages thereof.

SUMMARY OF THE INVENTION

These objects and others which will become apparent hereinafter are attained, in accordance with the present invention, in a racing apparatus which comprises, in addition to a track which can be the usual oval or can have the configurations, say of a rally or Grand Prix track, a plurality of gasoline powered remotely controlled cars (which can have the configuration of any conventional race cars) and which are each equipped with a forwardly trained video camera and a rearwardly trained video camera transmitting their signals by radio waves or other wireless transmission to a receiver from which the path in front of the car and the circumstances of the rear thereof are displayed on a main video screen and an auxiliary video screen to the upper right of the main video screen, in a booth for the operator.

Advantageously, this booth has the configuration of the driver's compartment of a racing car and indeed access to the booth may be through a window as is customary in some racing cars. Thus the booth can be equipped with a bucket seat, safety harness and roll bar, having the main video screen configured as the windshield of the racing car with the auxiliary video screen configured as the rearview mirror of the car.

The booth is equipped with a steering wheel coupled to the wireless transmitter for transmitting steering signals to the particular vehicle, with a clutch or gear shift lever, similarly coupled by conventional wireless transmission to a clutch operator and a shift lever operator or servomechanism of the vehicle, and an accelerator and brake pedal whose transmitters are tuned to the receiver frequencies of receivers of the vehicle and are actual operators for the brake and accelerator of the vehicle.

In addition, the various gauges of the vehicle representing engine temperature, engine speed (RPM), fuel level and vehicle speed (miles per hour or kilometers per hour) may be coupled to the vehicle transmitter for transmitting appropriate signals to a receiver associated with the particular booth and displaying these values on dashboard gauges within the booth. The booth may be equipped with other features commonly used with the vehicle, e.g. a starter button, a choke control . . . which, of course, are connected by the transmitter-receiver system described to the corresponding elements of the vehicle as well as means for tilting the booth from side to side corresponding to the turning of the vehicle.

While each of the controlled elements of the vehicle may be provided with a respective receiver wireless coupled with a corresponding transmitter of the booth, and each of the indicating elements of the vehicle can be provided with a respective transmitter wireless coupled with a receiver associated with the corresponding display elements of the booth, I prefer to assign to each of the vehicles a respective frequency band in the FM range and to transmit the signals from the booth to the vehicle and from the vehicle to the booth within this band via respective multiplexer-demultiplexer systems.

Thus the booths may be permanently established at the track and the vehicles may be owned by the respective operators so that the receiver and transmitter of each vehicle can be set to an assigned band when the operator appears with his vehicle at the track and is assigned a booth from which to operate the vehicle.

Naturally, of course, the vehicles can be owned by the track operators as well.

According to a feature of the invention, the forwardly directed video camera has a wide angle of view simulating the peripheral vision of an operator while the front fenders of the vehicle are provided with mirrors within this field of view so that along the edges of the main screen, images of rear right and left sides of the vehicle path are displayed in locations analogous to those in which they would be seen by the operator through such mirrors if the operator were in the vehicle. For the simulation of true track conditions in which the rearview mirror has a narrower field of view, the rearwardly directed camera can have a similarly narrow field of view.

According to another feature of the invention, the vehicles themselves are true scale reproductions of the corresponding full size vehicles whether a formula, stock car or other racing configuration. They can be, for instance, from one-fifth to one-third full size and can be fully equipped and powered with similarly scale down gas engines or electric motors, transmissions and the like, affording to the operator an opportunity to repair and maintain the vehicle just as he would a full size vehicle, although using correspondingly scaled down parts.

It is also possible to provide within the booth, to the extent that the booth may be removed from the track, an audio output representing sounds transmitted from the track, also by wireless transmission, so that the sound which is actually delivered is that which is picked up by a microphone at the respective vehicle.

The system of the invention thus affords a realistic operator position in which in all respects the operator feels and indeed is sitting in a racing vehicle and performing the very maneuvers required to keep his car in appropriate position on the track in relationship to other cars and the track configuration. He sees the track and the other cars just as he would if he were in the car.

The race is far more realistic and exciting than earlier systems.

SPECIFIC DESCRIPTION

Figure 1:
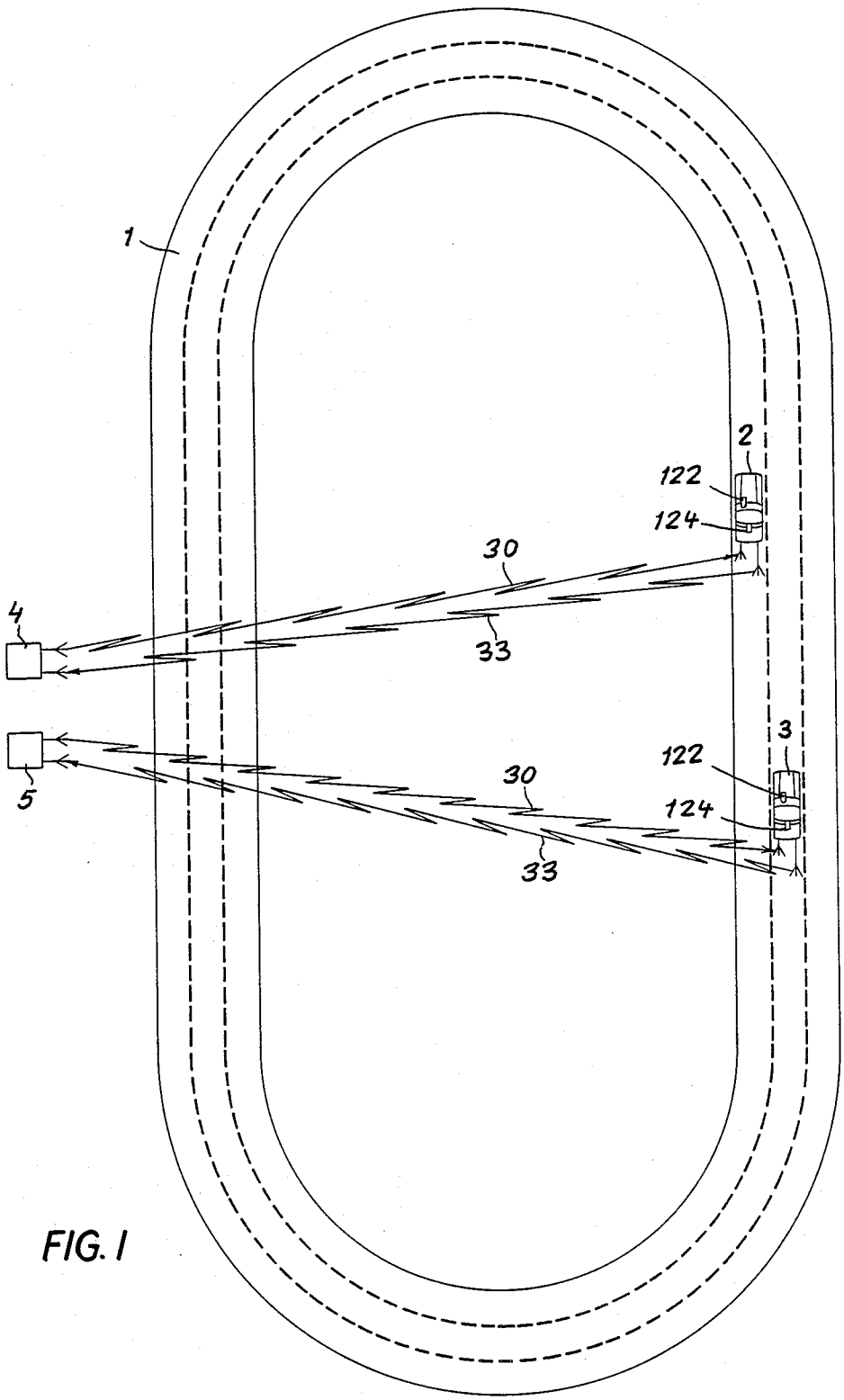
FIG. 1 is a diagrammatic plan view of a reduced-scale racing system according to the invention.

The reduced-scale racing system shown in FIG. 1 includes a racetrack 1 on which at least two self-powered vehicles 2 and 3 can travel under the remote control of respective operator's booths 4 and 5.

Figure 2:
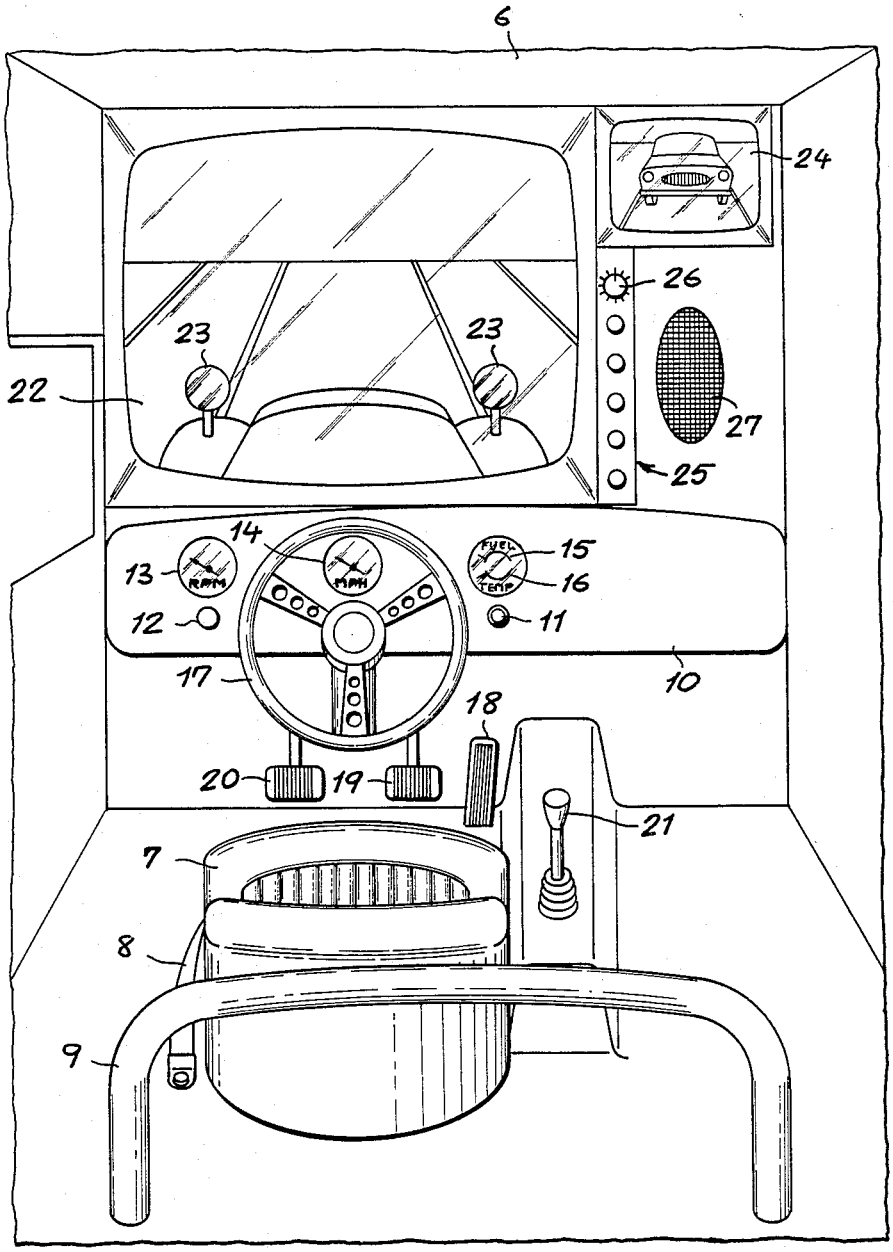
FIG. 2 is an elevational view of the interior of an operator's booth showing the control console.

As shown in FIG. 2, the interior of an operator's booth is configured to look like the driver's compartment of a race car and to that end has a housing 6 provided with a bucket seat 7 having a seat belt 8 and a rollbar 9 positioned behind the seat. Forwardly of the seat 7 is a dashboard 10 provided with an ignition switch 11, a choke 12, a tachometer 13, a speedometer 14, a fuel gauge 15 and a temperature gauge 16. Between the dashboard 10 and the seat 7 there is positioned a steering wheel 17, and beneath the dashboard, an accelerator pedal 18, a brake pedal 19 and a clutch pedal 20. Alongside the seat 7 there is provided a floor mounted gear selector 21. Above the dashboard 10 there is mounted a video display screen 22 representing the windshield of an automobile and giving a forwardly directed wide-angled view from one of the vehicles 2 or 3, in which can be seen the reflected sideview images in a pair of fendermounted mirrors 23 on the vehicle. At the upper right of the screen 22 there is mounted another smaller video display screen 24 representing the rearview mirror of an automobile and showing the narrowangled, rearwardly directed view from one of the vehicles. The panel above the dashboard 10 is also provided with various electronic controls 25, including a frequency selector 26, as well as a speaker 27 providing sound from the respective vehicle.

Figure 3:
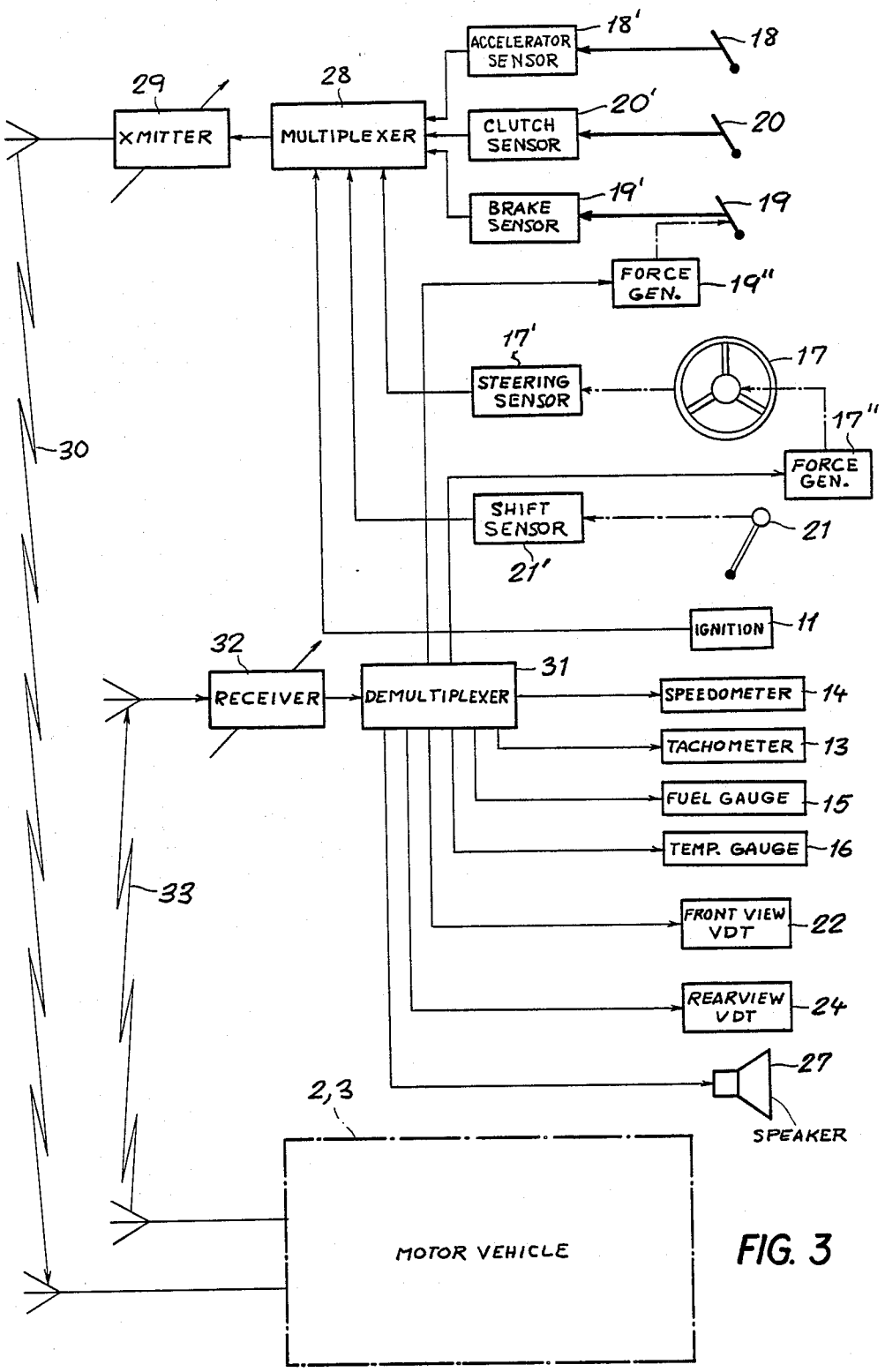
FIG. 3 is a diagrammatic view of the operational elements of the operator's booth.
Figure 4:
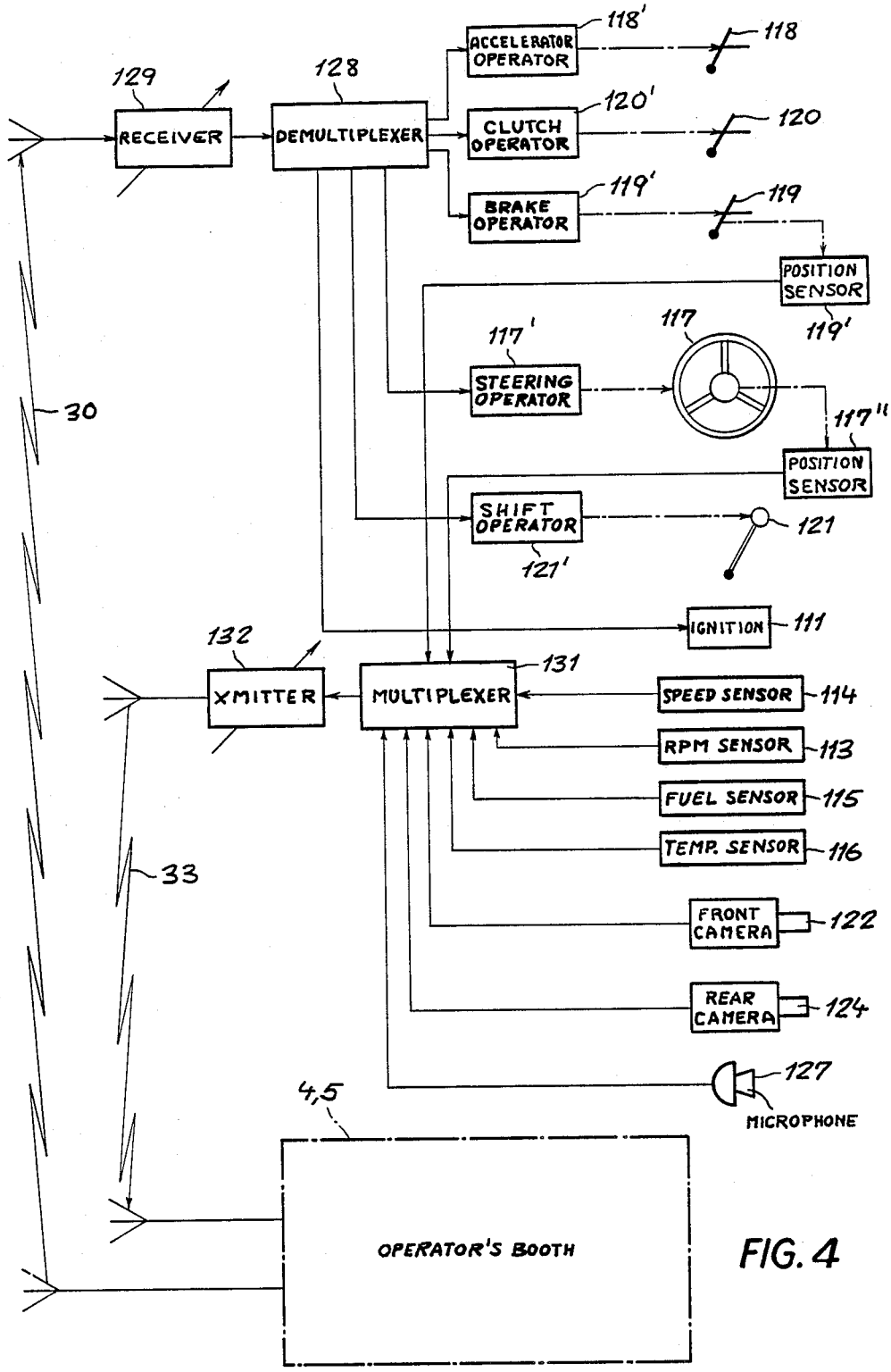
FIG. 4 is a diagrammatic view of the operational elements of a vehicle according to the invention.

The actual operation of the apparatus can be more clearly seen with reference to FIGS. 3 and 4, in which accelerator, brake and clutch pedals 18, 19 and 20 are shown to be operatively connected to respective sensors 18', 19' and 20', while steering wheel 17 and gear selector 21 are operatively connected to respective sensors 17' and 21'. The signals from all of these sensors are fed into an FM multiplexer 28 where they are coded and fed into an FM transmitter 29 having an adjustible frequency which can be selected to differ from those of other booths and vehicles operating on the racetrack. The multiplexed FM signal 30 is transmitted to the particular vehicle associated with the particular operator's booth, where it is intercepted by FM receiver 129, having a variable frequency tuned to that of transmission 30. The received signal is then fed into a demultiplexer 128, where the multiplexed signal is decoded and the various signals are distributed to respective operators 118', 119' and 120', which act to adjust respective accelerator, brake and clutch pedals 118, 119 and 120 of the vehicle in response to any adjustment made by the driver/operator in the booth, in a standard manner as taught by the Handbook of Telemetry and Remote Control by Elliot L. Gruenberg, published by McGraw-Hill, and Servomechanism Practice by W. R. Ahrendt and C. J. Savent, Jr., second edition, also published by McGraw-Hill. Additional operators 117' and 121' act to adjust steering wheel 117 and gear shift 121 respectively. Both the brake pedal 119 and the steering wheel 117 are provided with respective position sensors 119" and 117", which feed into the FM multiplexer 131, which in turn feeds into variable frequency FM transmitter 132, generating a signal 33 which is intercepted by FM receiver 32 in the booth and tuned to that frequency, and in turn fed into demultiplexer 31, where the respective signals from the sensors 119" and 117" are fed respectively to force generators 19" and 17", which act respectively on brake pedal 19 and steering wheel 17 to provide a sense of feedback from the vehicle to the driver/operator on the booth.

A front video camera 122 having a wide-angle lens and a rear video camera 124 having a narrow-angle lens are positioned in the vehicle to provide the views to respective screens 22 and 24, the cameras 122 and 124 also feeding into the multiplexer 131.

A microphone 127 is connected to multiplexer 131 and is positioned in the vehicle for providing the road sounds from the vehicle to the speaker 27 in the operator's booth, thus enhancing the illusion for the driver-/operator of actually being in the vehicle.

Respective RPM, speed, fuel and temperature sensors 113, 114, 115 and 116 are connected to multiplexer 131 for providing a reading of the operational conditions of the vehicle respectively to tachometer 13, speedometer 14, fuel gauge 15 and temperature gauge 16 in the operator's booth.

In the same manner as described for the other operational elements of the apparatus, the ignition switch 11 in the operator's booth operates the ignition 111 of the vehicle.

I claim:

1. A reduced-scale racing apparatus comprising:

at least one self-powered remotely controlled vehicle; and at least one operator's booth containing a control console for operating said vehicle, said vehicle comprising:

a race car body, first control means on said body for controlling travel of said vehicle, a forwardly trained video camera mounted on said body, a rearwardly trained video camera mounted on said body, transmitter means on said body for the wireless transmission of respective signals from said forwardly and rearwardly trained video cameras, and receiver means on said body responsive to wireless signals for operating said first control means;

said operator's booth comprising:

a housing for containing an operator and receiving said control console, second control means in said housing for generating wireless signals receivable by said receiver means for operating said first control means, a first video display screen in said housing responsive to the transmitted signals from said forwardly trained video camera for displaying the path in front of said vehicle, said first video display screen being positioned in front of the operator and configured as a windshield of a race car, and a second video display screen in said housing responsive to the transmitted signals from said rearwardly trained video camera for displaying the path in back of said vehicle, said second video display screen being positioned at the upper right of said first screen and configured as a rearview mirror of a car; and said body being further provided with a pair of sideview mirrors mounted within the field of view of said forwardly trained video camera for displaying the reflection thereof at the sides of said first video display screen.

2. The apparatus defined in claim 1 wherein said forwardly trained video camera has a wide angle of view for simulating the peripheral vision of an operator, and said rearwardly trained video camera has a narrow field of view for simulating a rearview mirror.

3. A reduced-scale racing apparatus comprising at least one self-powered remotely controlled vehicle; and at least one operator's booth containing a control console for operating said vehicle, said vehicle comprising:

a race car body, first control means on said body for controlling said vehicle, a forwardly trained video camera mounted on said body and having a wide angle of view for simulating the peripheral vision of an operator, a rearwardly trained video camera mounted on said body and having a narrow field of view for simulating a rearview mirror, transmitter means on said body for the wireless transmission of respective signals from said forwardly and rearwardly trained video cameras, and receiver means on said body responsive to wireless signals for operating said first control means;

said operator's booth comprising:

a housing for containing an operator and said control console, second control means in said housing for generating wireless signals receivable by said receiver means for operating said first control means, a first video display screen in said housing responsive to the transmitted signals from said forwardly trained video camera for displaying the path in front of said vehicle, said first video display screen being positioned in front of the operator and configured as a windshield of a race car, and a second video display screen in said housing responsive to the transmitted signals from said rearwardly trained video camera for displaying the path in back of said vehicle, said second video display screen being positioned at the upper right of said first screen and configured as a rearview mirror of a car; and said body being further provided with a pair of sideview mirrors mounted within the field of view of said forwardly trained video camera for displaying the reflections thereof at the sides of said first video display screen.

4. A reduced-scale racing apparatus comprising:

at least one self-powered remotely controlled vehicle; and at least one operator's booth containing a control console for operating said vehicle, said vehicle comprising:

a race car body, first control means on said body for controlling said vehicle, a forwardly trained video camera mounted on said body, a rearwardly trained video camera mounted on said body, transmitter means on said body for the wireless transmission of respective signals from said forwardly and rearwardly trained video cameras, receiver means on said body responsive to wireless signals for operating said first control means, a steering wheel on said body operable by said first control means, an accelerator on said body operable by said first control means, a brake on said body operable by said first control means, and feedback means on said body operable by said first control means, and feedback means on said body operable by said steering wheel and said brake for the transmission of respective signals therefrom and receivable by said operator's booth for providing a braking and steering sensation to an operator therein;

said operator's booth comprising:

a housing for containing an operator and said control console, second control means in said housing for generating wireless signals receivable by said receiver means for operating said first control means, a first video display screen in said housing responsive to the transmitted signals from said forwardly trained video camera for displaying the path in front of said vehicle, and a second video display screen in said housing responsive to the transmitted signals from said rearwardly trained video camera for displaying the path in back of said vehicle, said second video display screen being smaller than said first video display screen, being configured as a rear view mirror and being located to the upper right of said first screen; and said body being further provided with a pair of sideview mirrors mounted within the field of view of said forwardly trained video camera for displaying the reflections thereof at the sides of said first video display screen, said forwardly trained video camera having a relatively wide field of view and said rearwardly trained video camera having a relatively narrow field of view.

5. The apparatus defined in claim 4 further comprising a plurality of sensors including a microphone on said body of said vehicle for the transmission of respective signals therefrom and receivable by said operator's booth for providing a reading of vital signs including sound from said vehicle to an operator in said housing.

6. The apparatus defined in claim 4 wherein said first control means includes respective accelerator, steering, brake, transmission and clutch operators, and said second control means includes respective accelerator, steering, brake, gear selector and clutch sensors.

7. The apparatus defined in claim 4 wherein said transmitter means on said body is frequency modulated, and said receiver means on said body is frequency modulated.

8. The apparatus defined in claim 7 wherein the frequency modulated signal from said transmitter means is multiplexed for the transmission of respective signals therefrom at a single frequency, and said receiver means is multiplexed for the reception of respective signals at a single frequency.

9. The apparatus defined in claim 4 wherein said operator's booth further comprises a bucket seat, a seat belt and a roll bar in said housing, said housing being in the configuration of the driver's compartment of a race car, and said body of said vehicle is a reduced-scale accurate replica of a full-sized race car.

10. The apparatus defined in claim 8 further comprising:

a racetrack on which said first mentioned vehicle can travel under the control of said first mentioned operator's booth at said racetrack;

at least one second vehicle operable on said racetrack;

at least one second operator's booth at said racetrack for operating said second vehicle, said first vehicle and operator's booth having a variable operating frequency and said second vehicle and operator's booth having a variable operating frequency, whereby said respective first and second vehicles and operator's booths can operate simultaneously at different frequencies.

* * * * *